US005335593A

United States Patent [19]

Stoddard et al.

[11] Patent Number: 5,335,593

[45] Date of Patent: Aug. 9, 1994

[54] DISPLAY STAND

[75] Inventors: David C. F. Stoddard, Atlanta; Ladd M. Orr, Clarkston, both of Ga.; Alan D. Cooper, Winston Salem, N.C.; Jeffrey J. Jarmuz, Colgate, Wis.

[73] Assignee: The Mead Corporation, Dayton, Ohio

[21] Appl. No.: 877,658

[22] Filed: May 1, 1992

[51] Int. Cl.[5] ..... A47B 3/00

[52] U.S. Cl. ..... 108/165; 108/180

[58] Field of Search ..... 108/111, 112, 153, 165; 248/174, 108.8; 211/132, 195

[56] References Cited

U.S. PATENT DOCUMENTS

| | | | |
|---|---|---|---|
| 2,283,406 | 5/1942 | Bacon | 248/174 |
| 3,721,413 | 3/1973 | Robinson | 248/174 |
| 4,169,287 | 8/1979 | Muller et al. | 108/111 X |
| 4,231,299 | 11/1980 | Gebhardt et al. | 108/111 X |
| 4,296,524 | 10/1981 | Horholt et al. | 108/112 X |
| 4,506,790 | 3/1985 | Muscari | 108/111 X |
| 4,854,246 | 8/1989 | Belokin et al. | 108/111 |
| 4,860,667 | 8/1989 | Cardenas et al. | 108/111 X |
| 4,942,830 | 7/1990 | Macaluso et al. | 108/111 |
| 4,991,813 | 2/1991 | Beaulieu | 248/174 X |

FOREIGN PATENT DOCUMENTS

| | | | |
|---|---|---|---|
| 1139639 | 7/1957 | France | 248/174 |

*Primary Examiner*—Jose V. Chen

*Attorney, Agent, or Firm*—Rodgers & Rodgers

[57] ABSTRACT

A corrugated paperboard display stand includes base structure, vertical corner posts supported by the base structure, a plurality of shelves supported by the corner posts, a horizontal cross section of each of the corner posts being at least in part of arcuate configuration and being arranged to support the shelves.

21 Claims, 13 Drawing Sheets

DISPLAY STAND

TECHNICAL FIELD

This invention pertains primarily to point of purchase marketing of a variety of items such for example as potato chips and the like.

BACKGROUND ART

The prior art is schematically represented in FIG. 1 of the drawings. This view in conjunction with applicants' FIG. 2 of the drawings is designed to bring out the fact that corner posts constructed according to this invention afford a minimum obstruction of the displayed items from the view of the purchaser.

SUMMARY OF THE INVENTION

According to this invention in one form, a display stand includes vertical corner posts constructed so that a horizontal cross section is of arcuate configuration so as to provide a structure which is mechanically strong and which affords a minimum obstruction of the displayed items so that a prospective purchaser may view the items on display with a minimum of visual interference.

According to one form of the invention, a horizontal cross section of a display stand post which is of arcuate configuration may be provided with structure which constitutes a chord of the arcuate structure and which affords substantial reinforcement to the corner post which normally is constructed of corrugated paperboard.

BRIEF DESCRIPTION OF THE DRAWINGS

In the drawings

FIG. 24 shows a corner post comprising a section which is of arcuate horizontal cross section while FIGS. 22, 23, 25, 26 and 27 show a variety of structures wherein corner posts having a horizontal cross section of arcuate configuration are provided with chordal structure which bridges the ends of the arcuate portion of the corner posts.

BEST MODE OF CARRYING OUT THE INVENTION

Figure 1:
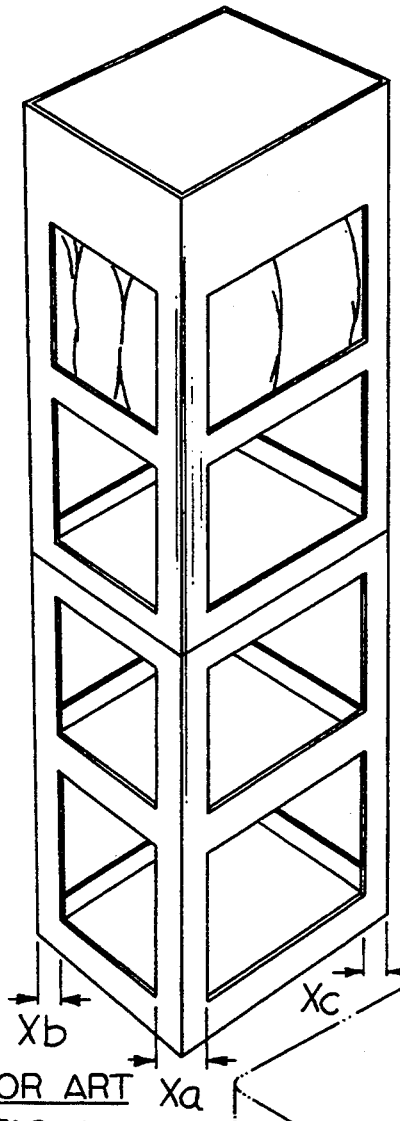
PRIOR ART FIG. 1
FIG. 1 is a schematic representation of pertinent prior art.
Figure 2:
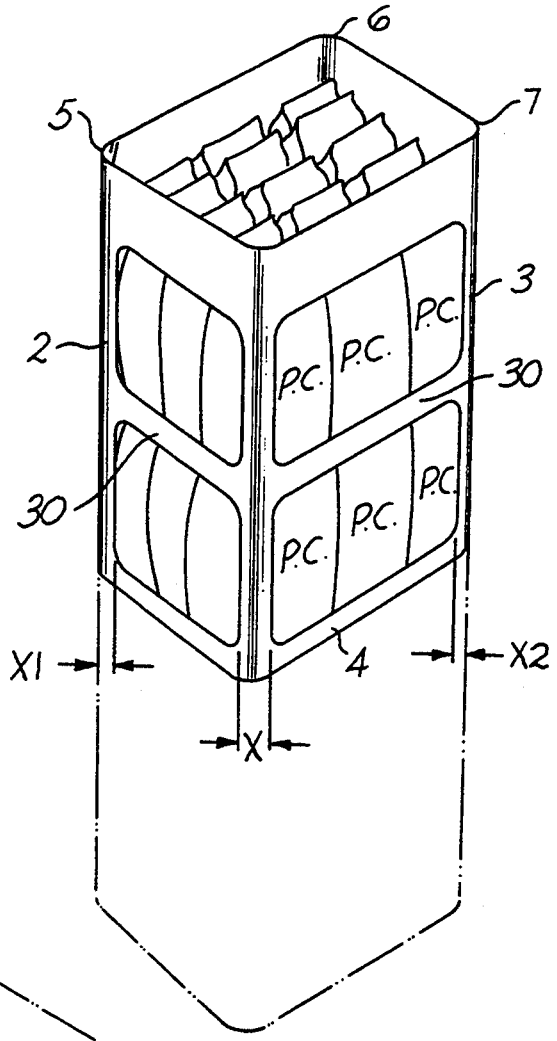
FIG. 2 is a perspective view of one form of the invention.

As is evident from the perspective view shown in FIG. 2 as observed from a generally diagonal vantage point, the space obstructed by the vertical corner post 1 as represented by the letter X is much narrower than the space designated in FIG. 1 by the letter Xa. Also the vertical corner post 2 and 3 in FIG. 2 afford a minimal visual obstruction as represented by the letter X1 and X2. These dimensions when compared with the dimension Xb and Xc in FIG. 1 afford far less obstruction than the corresponding structure shown in FIG. 1 and which structure is formed according to this invention. As is indicated in FIG. 2, this stand is used for displaying a plurality of packages such as potato chips indicated at PC.

Figure 4:
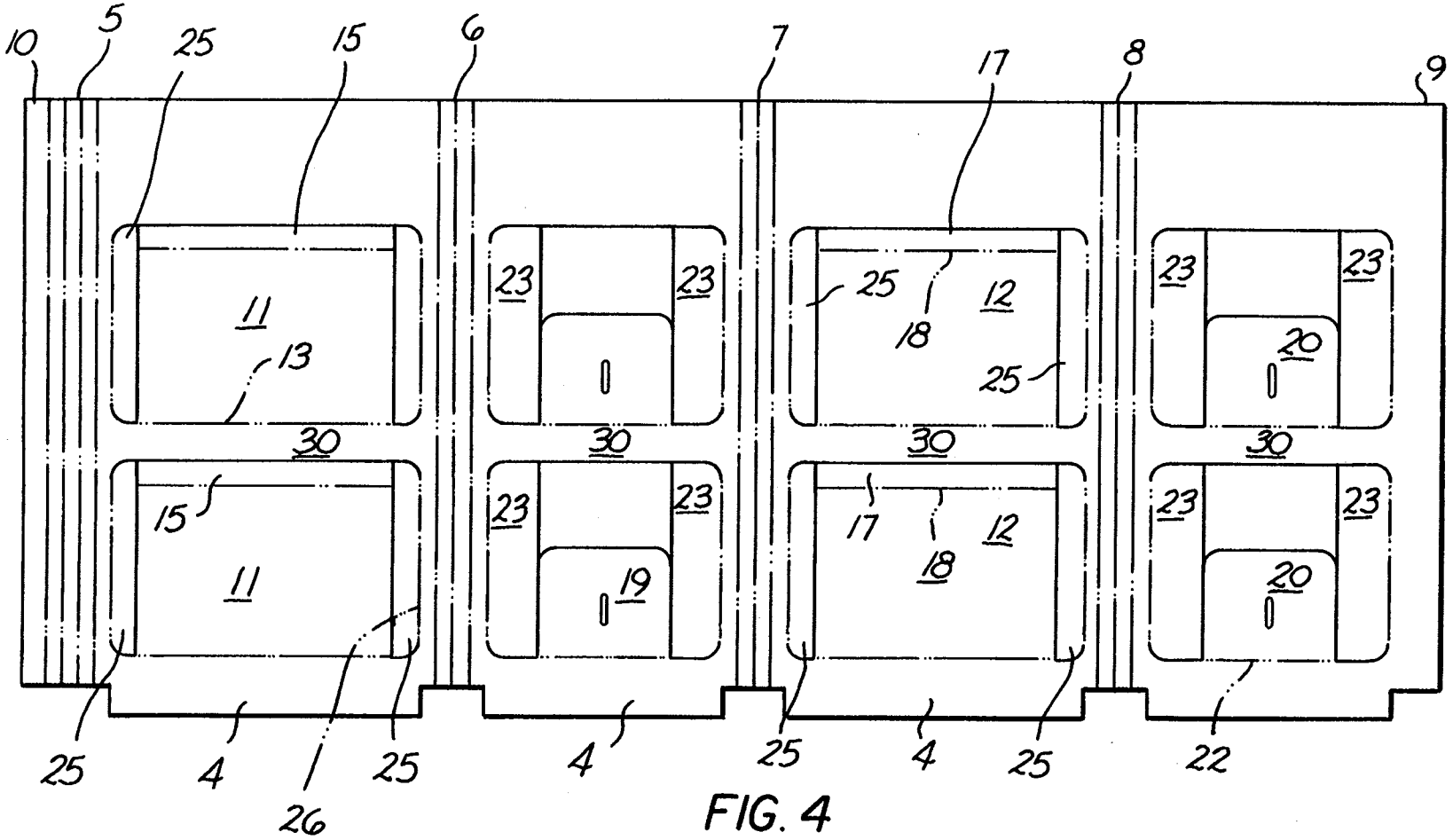
FIG. 4 is a plan view of a blank from which structure such as is shown in FIG. 2 is formed.

The blank structure shown in FIG. 4 includes base structure designated by the numeral 4. Four corner posts are shown in planar condition as indicated by crease lines 5, 6, 7 and 8.

Figure 5:
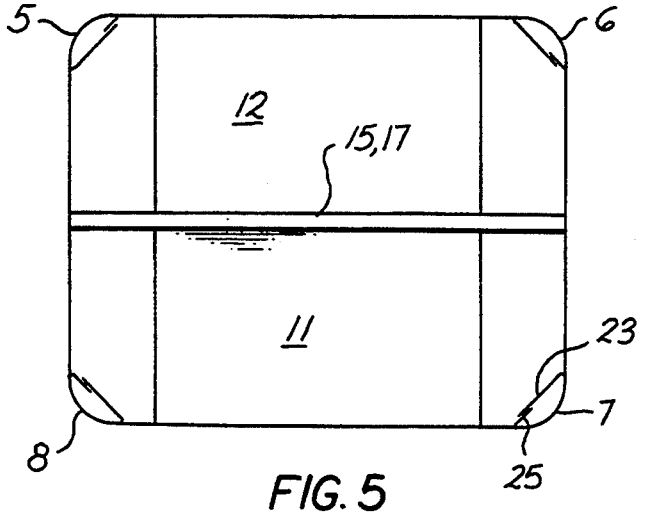
FIG. 5 is a plan view from above of the structure such as is shown in FIG. 2 and which is formed from the blank of FIG. 4.
Figure 6:
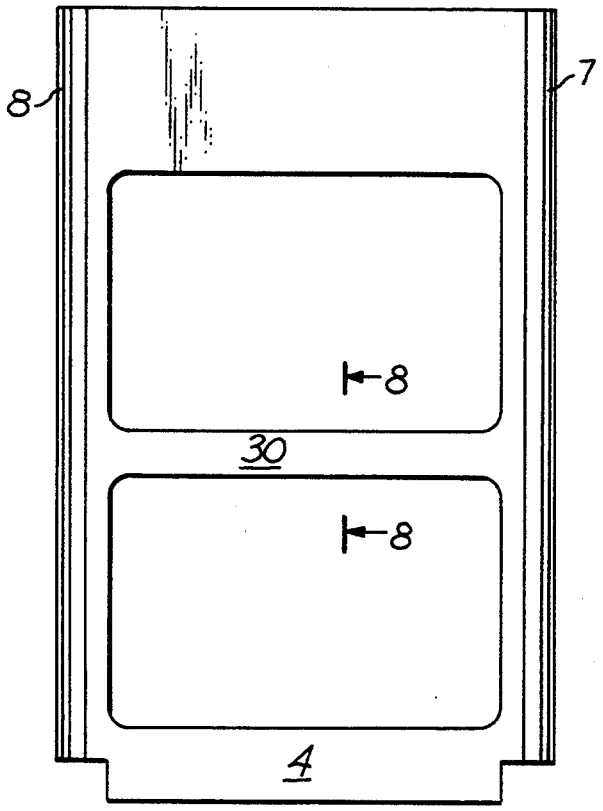
FIG. 6 is a side view structure such as FIG. 2.
Figure 7:
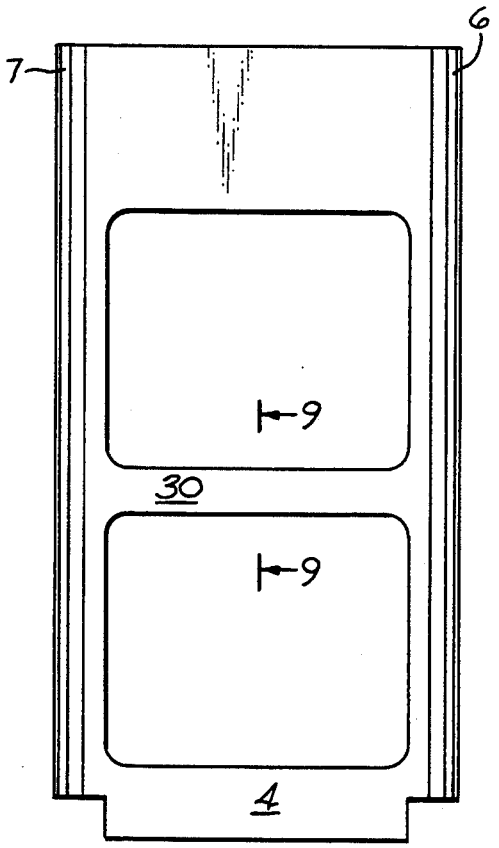
FIG. 7 is an end view of structure shown in FIG. 6.

In order to form a display stand from the blank of FIG. 4, the blank is manipulated so as to bring the glue lap 9 into flat face contacting relation with the glue lap 10 thus to form a structure of quadrilateral cross sectional configuration. The bottom half shelves 11 and 12 are foldably joined along fold lines 13 and 14 to the base structure 4. A medial strut 15 is foldably joined to half shelf 11 along fold line 16 and medial strut 17 is foldably joined to half shelf 12 along fold line 18. To complete the bottom shelf structure, a second pair of shelf elements 19 and 20 are foldably joined to base structure 4 along fold lines 21 and 22 respectively. A securing flap 23 is foldably joined along fold line 24 to a side edge of the arcuate portion of corner post 6 and a securing strip 25 is foldably joined along fold line 26 to an edge of the arcuate portion of corner post 6. When the blank of FIG. 4 is set up in normal condition, the securing flap 23 is folded in chord like fashion into face contacting relation with securing strip 25 to occupy positions such as are indicated at 25 and 23 in FIG. 5. These elements are secured together in any suitable manner as by adhesive, stapling or otherwise. Of course, the chord formed by secured together flaps 23 and strips 25 add substantially to the mechanical strength of a corner post such as 6.

The structure of the second shelf is designated by the same numerals as are used in designating the components of the bottom shelf just described except that the base structure designated by the numeral 4 constitutes support means arranged to interconnect the associated shelf elements 11, 12, 19 and 20 with the part of each corner post which is of arcuate configuration while the second or top shelf utilizes the side strips 30 as support means arranged to interconnect the associated shelf elements with the parts of each of the adjacent corner posts which are of arcuate configuration.

Figure 8:
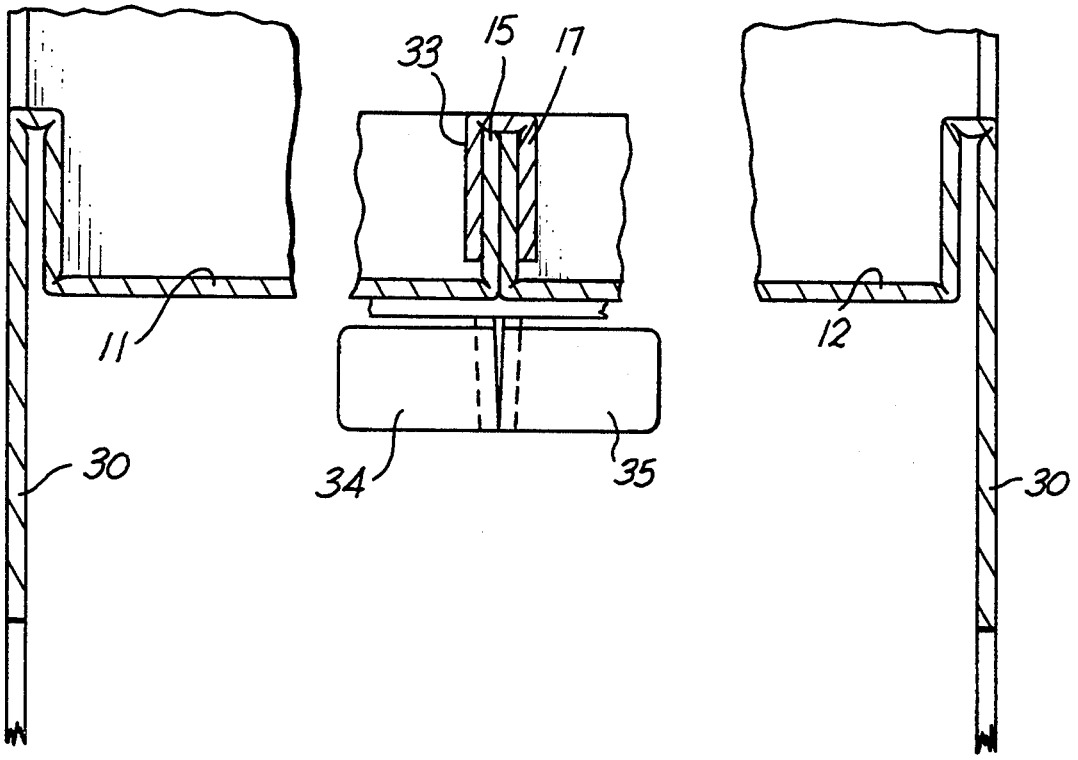
FIG. 8 is a cross sectional view taken along the line designated 8—8 in FIG. 6.
Figure 9:
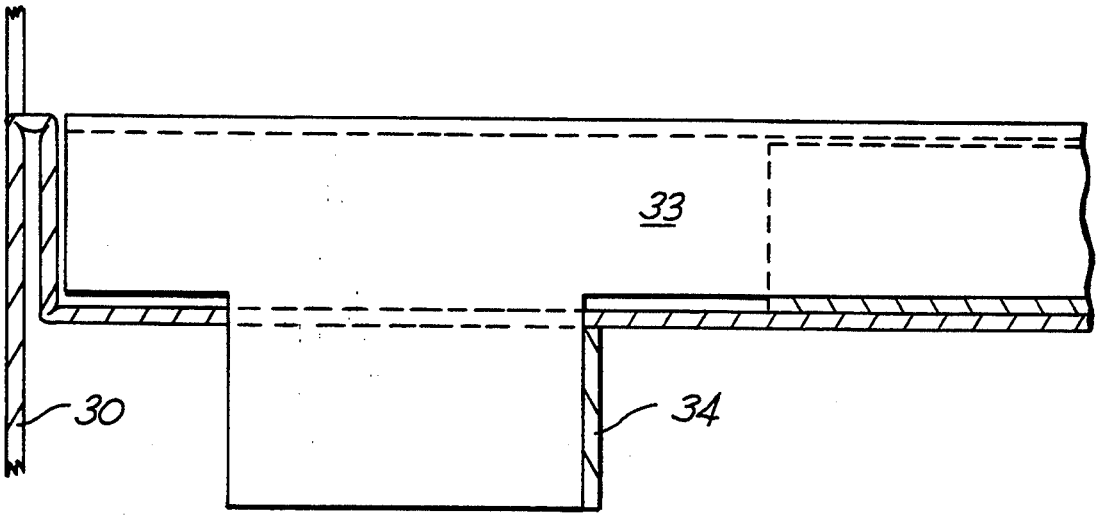
FIG. 9 is a cross sectional view taken along the line designated 9—9 in FIG. 7.
Figure 10:
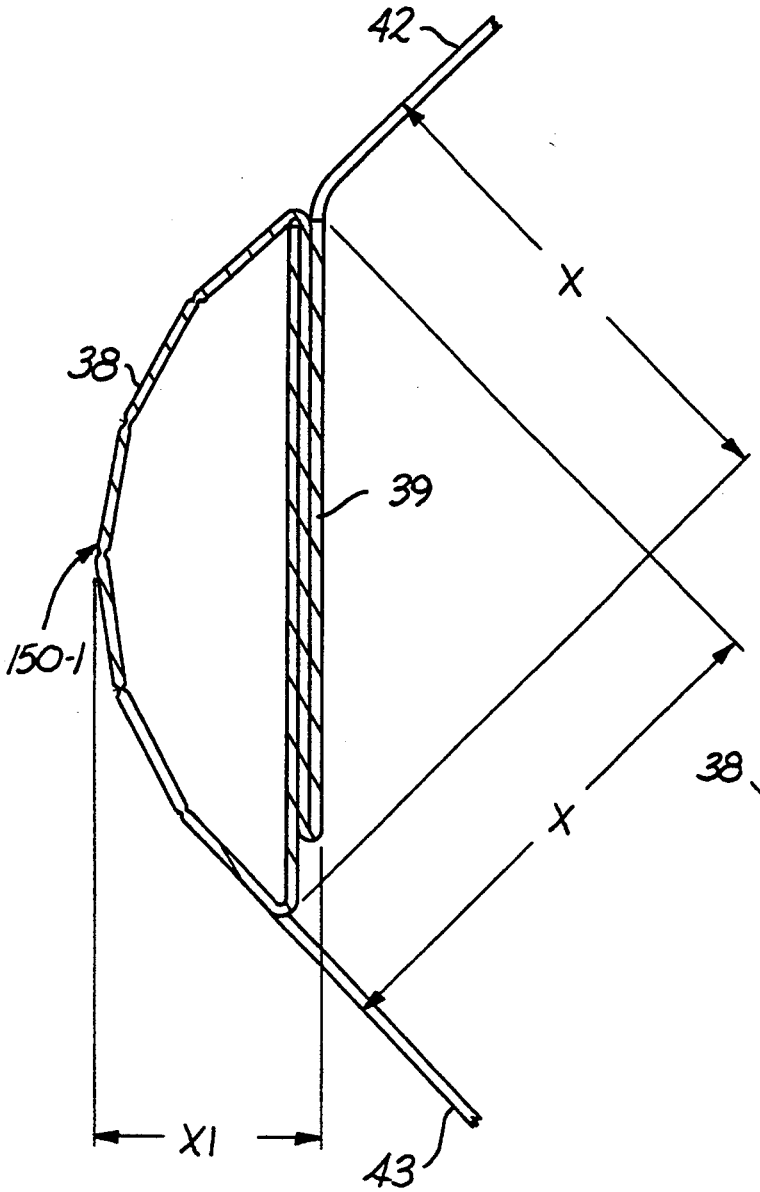
FIG. 10 is an enlarged cross sectional view of a corner post formed according to one form of this invention.
Figure 11:
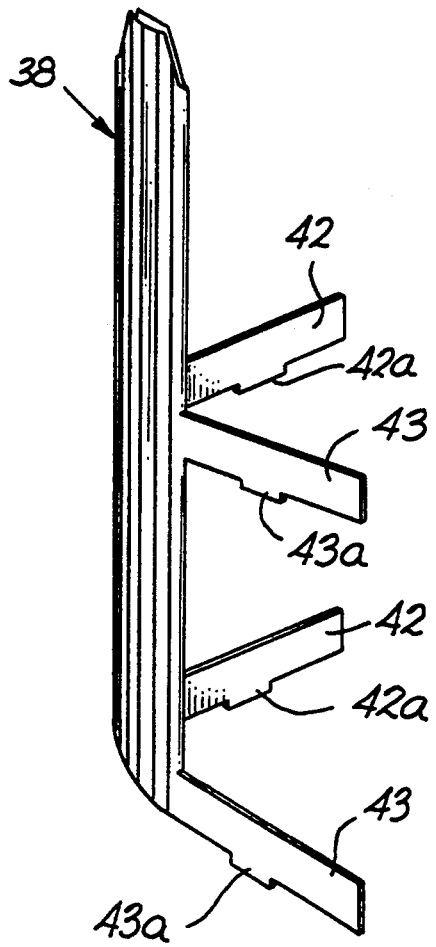
FIG. 11 is a perspective view of a corner post formed according to this invention and to which two pairs of supporting arms are integrally formed.
Figure 13:
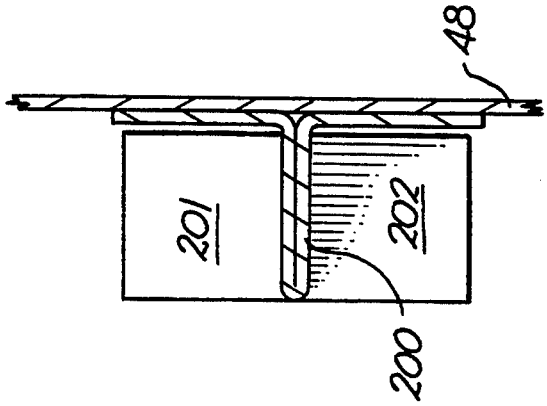
FIG. 13 is a cross sectional view taken along the line designated 13—13 in FIG. 12.

In order to reinforce the medial struts 15 and 17, an inverted U-shaped beam 33 is provided as best shown in FIG. 8. Preferably the beam 33 is provided with downwardly extending tabs 34 and 35.

Another modification of the invention as shown in FIGS. 3, 10, 11, 12, 13, 14 and 15 includes the arcuate portion 38 taken in a cross sectional horizontal plane together with chordal structure designated 39 which is integral with the lower end portion of the arcuate portion 38 together with the panel 40 which is doubled back on itself as indicated at 41. Panel 41 is integral with arm 42 and arcuate portion 38 is integral with arm 43.

Figure 12:
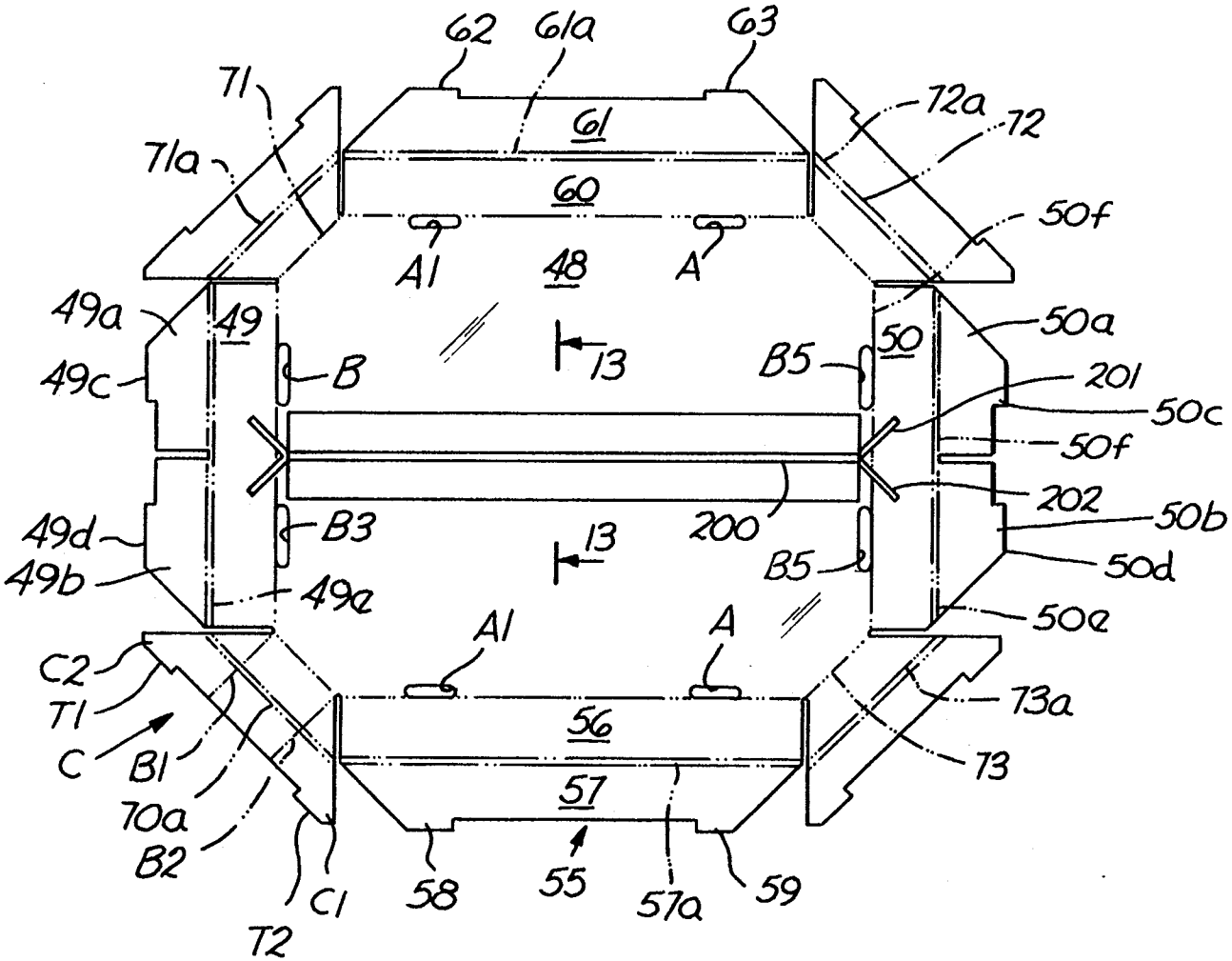
FIG. 12 is a plan view of a shelf structure formed according to a modification of this invention.
Figure 15:
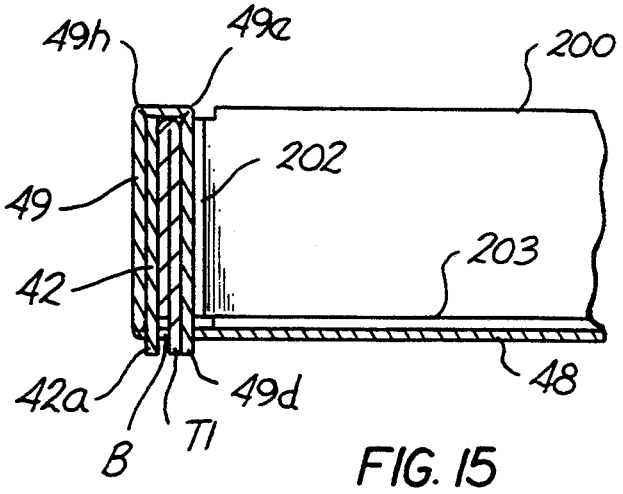
FIG. 15 is an enlarged cross sectional view showing the manner in which the outstanding arms shown in FIGS. 11 are enveloped by side and end structure constituting parts of the blank shown in FIG. 12.

With reference to FIG. 12, the blank there shown includes a plan view of a shelf having a main panel 48 to one end 49*f* of which end structure including panel 49 is foldably joined. A pair of outer panels 49*a* and 49*b* are foldably joined to panel 49 along fold line 49*e*. A tab 50C is formed on outer panel 50*a* and a tab 50*d* is formed on panel 50*b*. At the other end of the blank inner panel 50 is foldably joined to main panel 48 along fold line 50*f* and outer panels 50*a* and 50*b* are foldably joined to inner panel 50 along fold line 50*e*. A tab 50*c* is formed on an edge of outer panel 50*a* while a tab 50*d* is formed on the outer edge of outer panel 50*b*.

Side structure 55 includes a panel 56 foldably joined to main panel 48 along fold line 56*a*. A panel 57 is foldably joined to panel 56 along double fold line 57*a*. Tabs 58 and 59 are formed on the outer edge of panel 57.

On the other side of the blank, inner panel 60 is foldably joined to the side edge of blank 48 along fold line 60*a* and a panel 61 is foldably joined to panel 60 along double fold line 61*a* and includes tabs 62 and 63. Side and end structures envelope a support arm such as 42 and 43 shown in FIG. 11 Two apertures A are formed in main panel 48 adjacent fold line 56*a* and two apertures A1 are formed in panel 48 adjacent fold line 60*a*. A pair of apertures B are formed in panel 48 adjacent fold line 49*f* and a pair of apertures B5 are formed in panel 48 adjacent fold line 50*f*.

Figure 14:
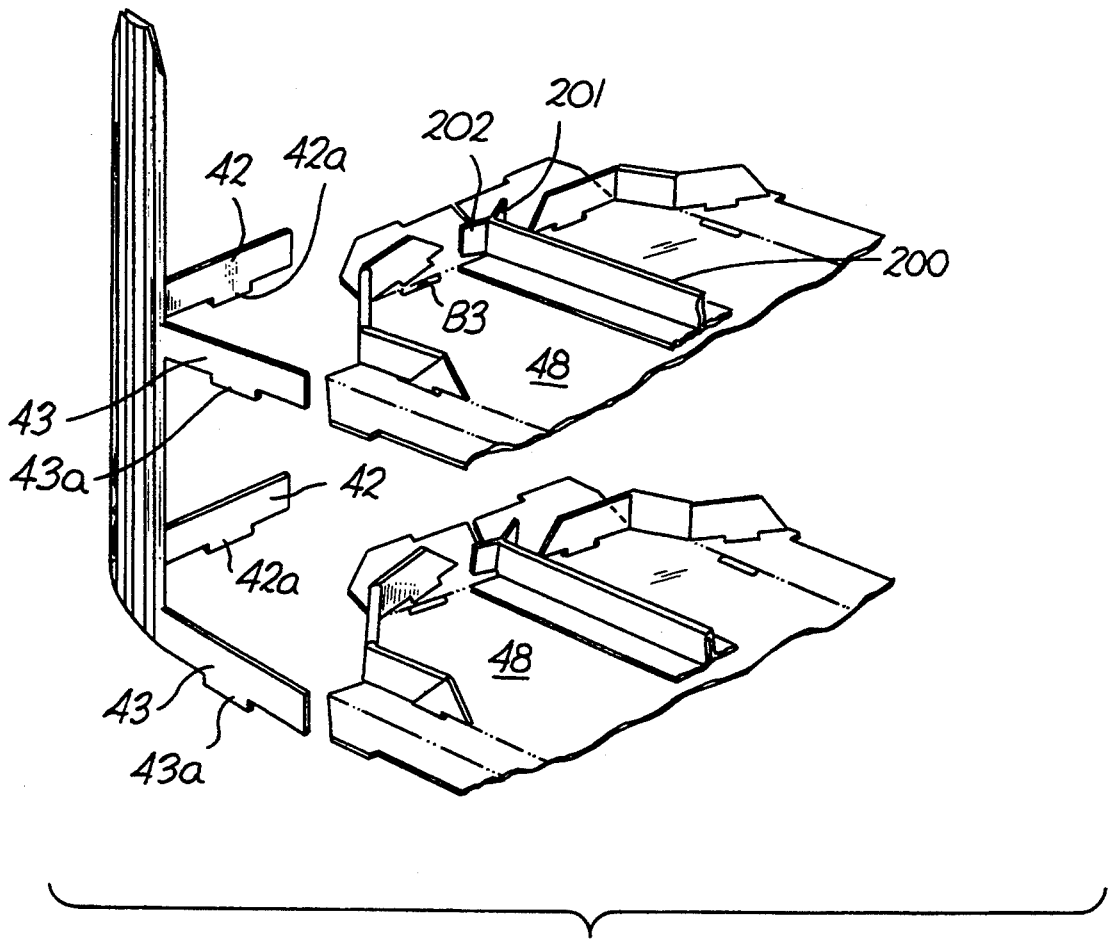
FIG. 14 is an exploded perspective view showing the structure of FIG. 11 in conjunction with the shelf structure shown in FIG. 12 and wherein the components of FIG. 14 are in partially set up condition.
Figure 14A:
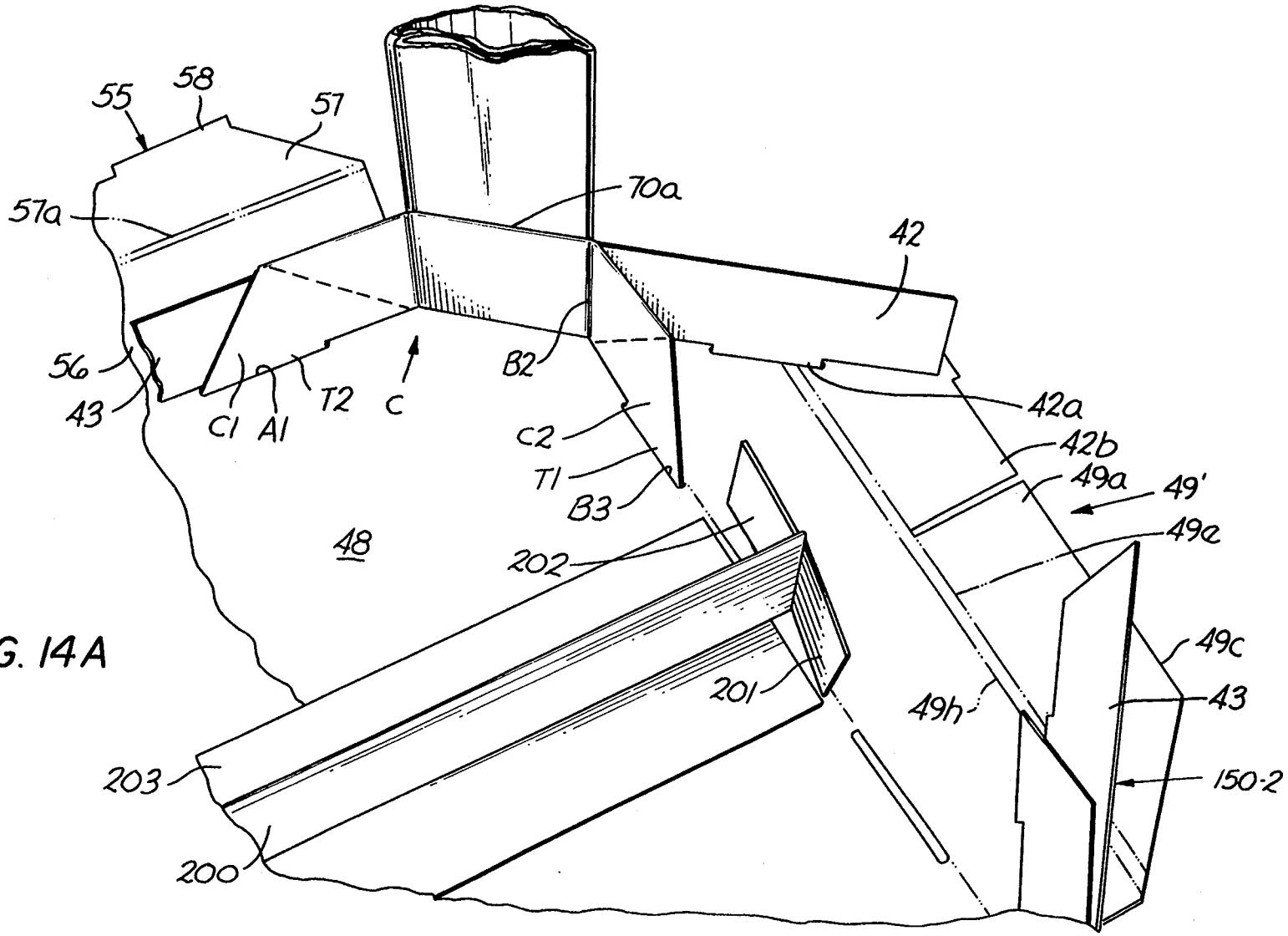
FIGS. 14A and 14B are enlarged perspective views from the inside showing stages through which the parts of one corner of the blank of FIG. 12 are manipulated to mate with the post of FIG. 10.

The blank as shown in FIG. 12 includes bevelled corners 70, 71, 72 and 73. The trapezoidal figures that are foldably joined to the bevelled corners of the blank include medial fold lines 70*a*, 71*a*, 72*a*, and 73*a* respectively. These trapezoidal figures are folded into collapsed condition by folding the opposite panels along the fold lines 70*a*, 71*a*, 72*a* and 73*a*. Once the trapezoidal structures at each corner of the blank of FIG. 12 are folded into collapsed condition along their medial fold lines, each composite structure is then folded into vertical perpendicular relationship with the main panel 48 of the blank by folding along the bevelled corners 70–73. Thereafter the collapsed structures are bent along bend lines such as are indicated at B1 and B2 to form the center structure C and the side structure C1 and C2 and so as to condition the blank for inserting the tab such as T2 into the appropriate aperture such as A1. Also tab 43*a* is inserted into aperture A1. Tab T1 is inserted into aperture B3 along with tab 42*a* on arm 42. The structure as shown in FIG. 14A is manipulated into the condition shown in FIG. 14B. When appropriately manipulated, the side and end structures envelope the arms 42 and 43 at each corner of the blank of FIG. 12 to form a complete shelf in accordance with one modification of this invention.

Figure 3:
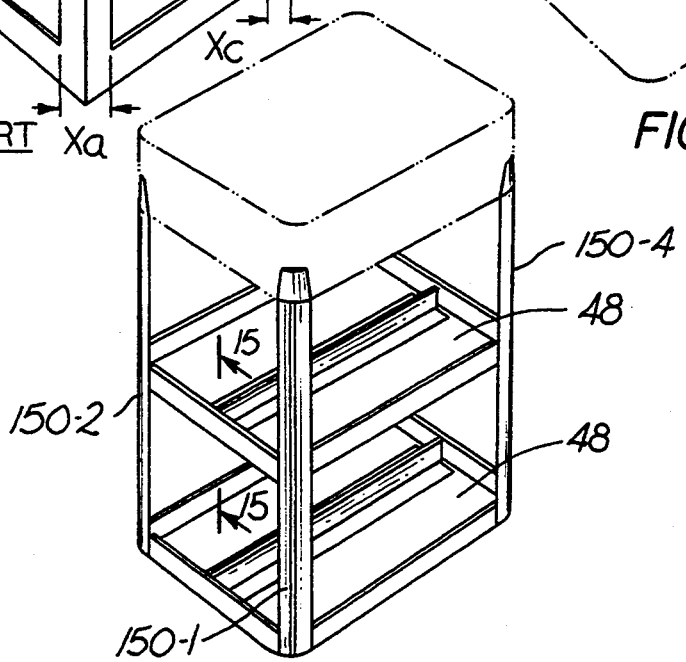
FIG. 3 is a perspective view of another form of the invention.
Figure 14B:
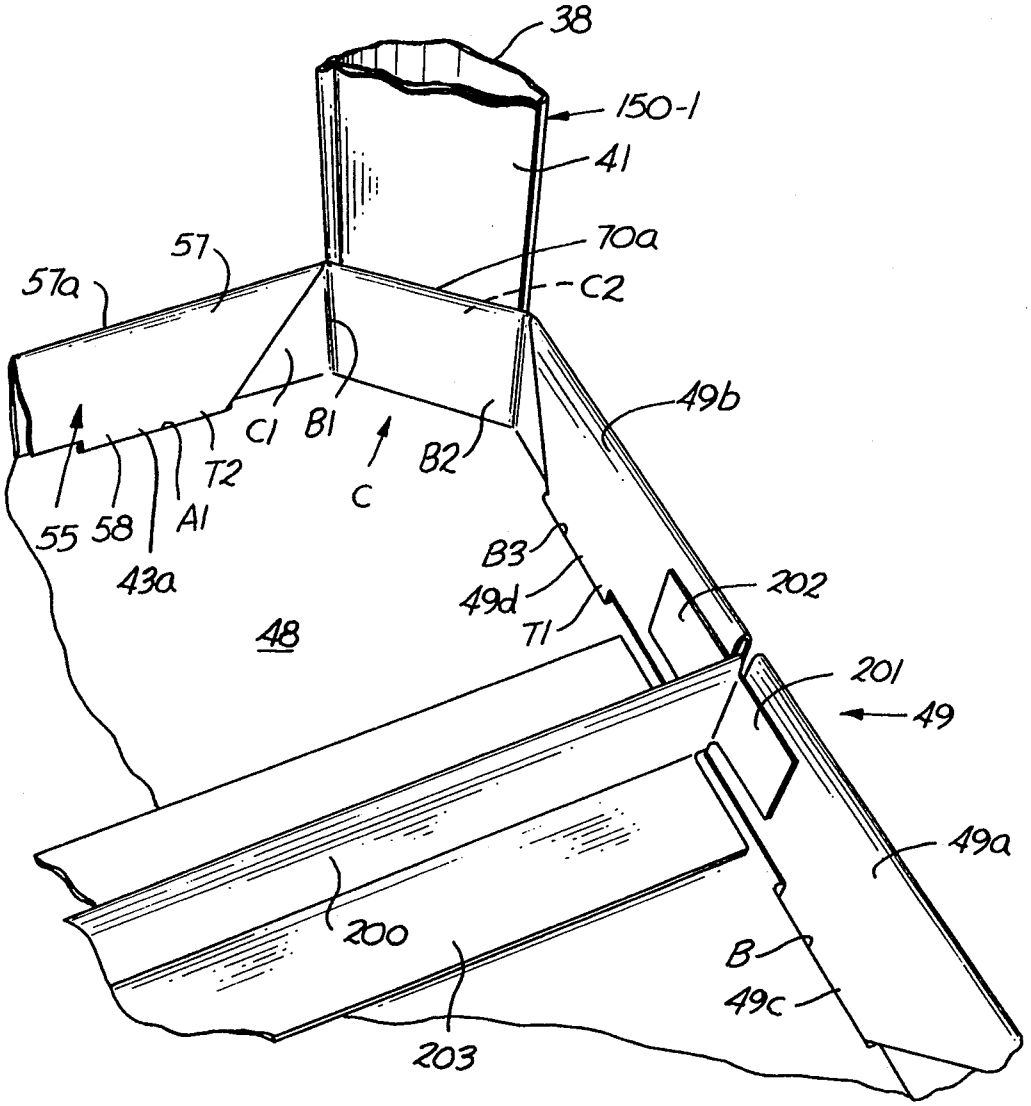

As best shown in FIGS. 12 and 14B medial strut 200 includes flaps 201 and 202 which are secured by adhesive or by other suitable means to the panels 49*a* and 49*b* respectively and by this means the strength of main panel 48 is substantially increased. In FIG. 3 corner posts 150-1, 150-2 and 150-4 are designated.

Figure 16:
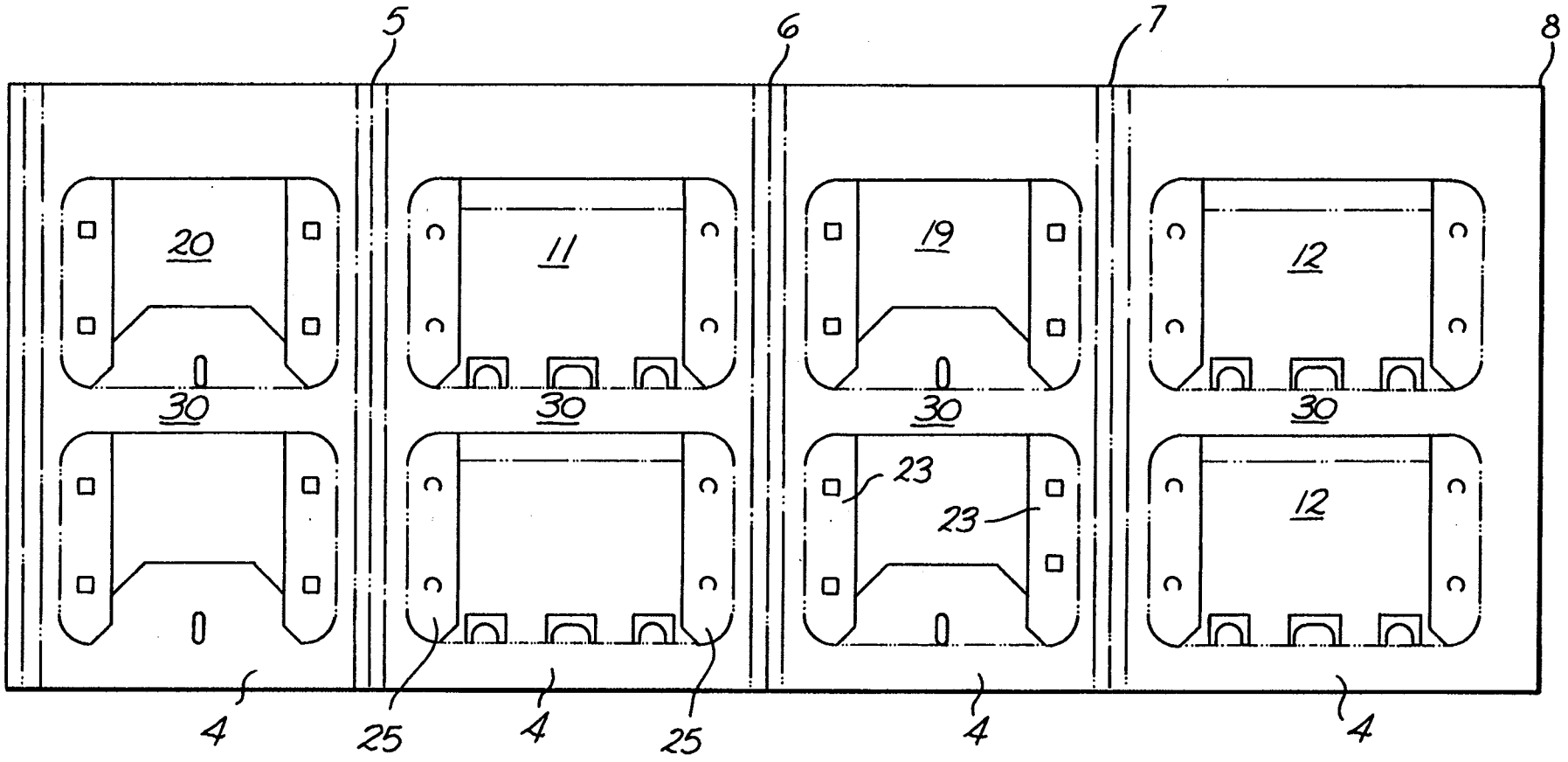
FIG. 16 is a view similar to FIG. 4 and represents a second modification of the invention.

Another modification of this invention is represented by the blank shown in FIG. 16. While the blank of FIG. 16 is not identical to the blank of FIG. 4, it is similar in all basic respects and a detailed explanation of FIG. 16 is not deemed necessary.

Figure 17:
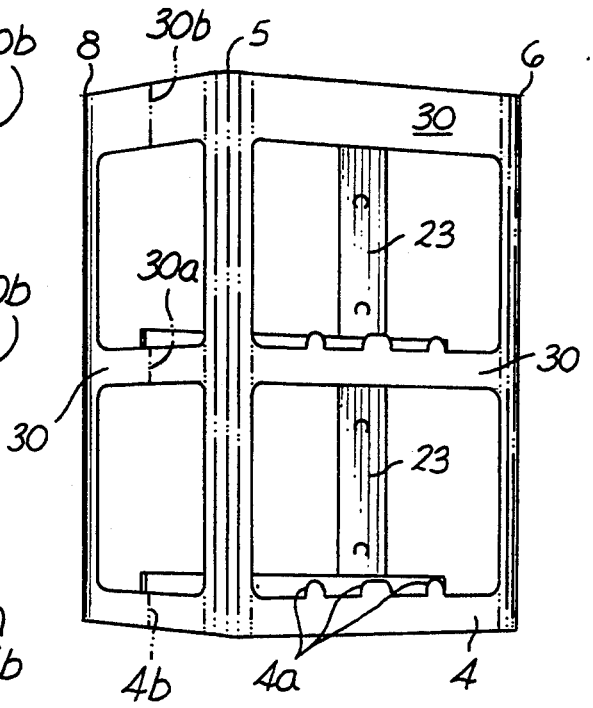
FIG. 17 is a perspective view of a display stand formed from the blank shown in FIG. 16.
Figure 19:
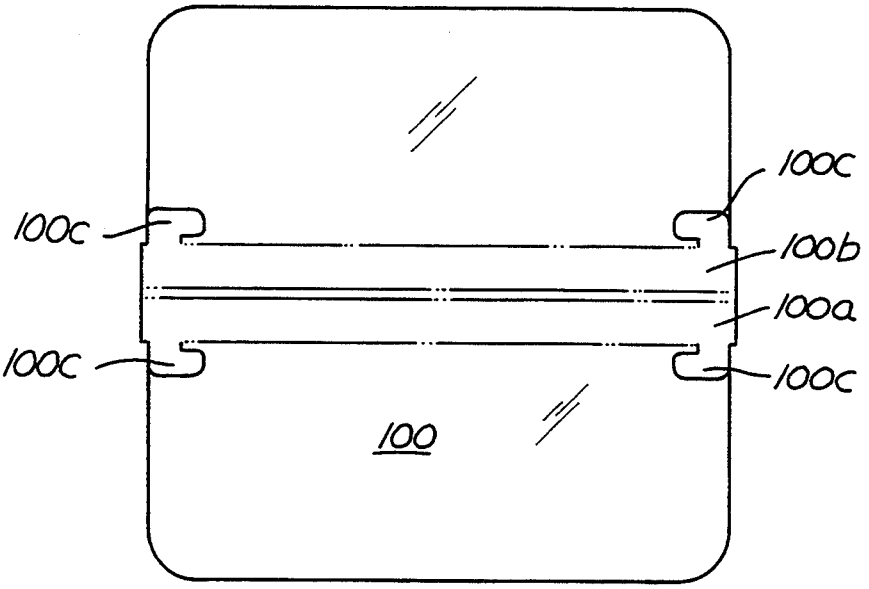
FIG. 19 is a plan view of a separate blank utilized as a reinforcing member for the stand shown in FIGS. 17 and 18.

The set up display stand as shown in FIG. 17 is formed from FIG. 16 and includes small upstanding projections 4*a* which aid in retaining displayed items within the confines of the stand. Also the structure of FIG. 17 may be collapsed into the condition represented in FIG. 18 as a space saving procedure. Toward this end, the base panel 4 is simply folded outwardly along fold lines 4*b* and the side strips 30 are folded outwardly along fold lines 30*b*, 30*a* and side strip 30 is folded outwardly along fold line 30*b*.

Figure 18:
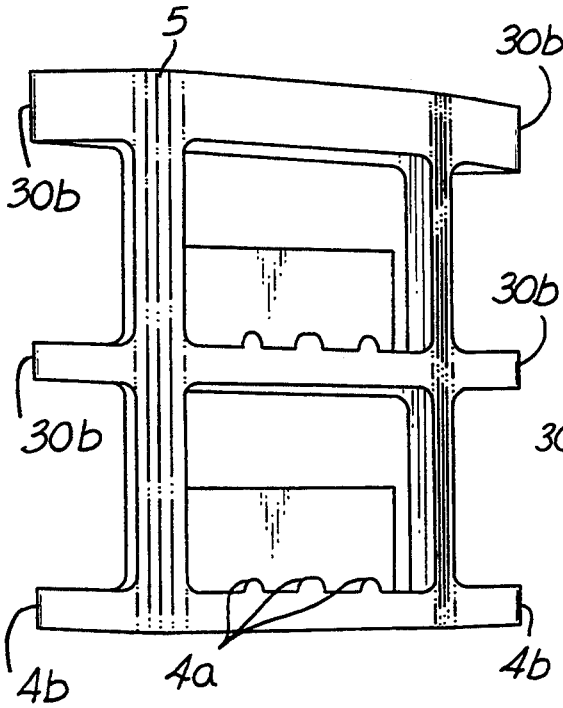
FIG. 18 is a side view of the structure shown in FIG. 17 after the structure in FIG. 17 has been collapsed along fold lines formed medially in certain horizontal elements of the structure.

In order to reinforce the shelf of the stand shown in FIGS. 17 and 18 an additional separate shelf 100 may be employed. Shelf 100 includes inner panels 100*a* and 100*b* which are folded into flat face contacting relation with each other and the tabs 100*c* are folded downwardly and underneath the shelves of FIGS. 17 and 18 so as to form a sturdy and reliable mechanical structure.

Figure 20:
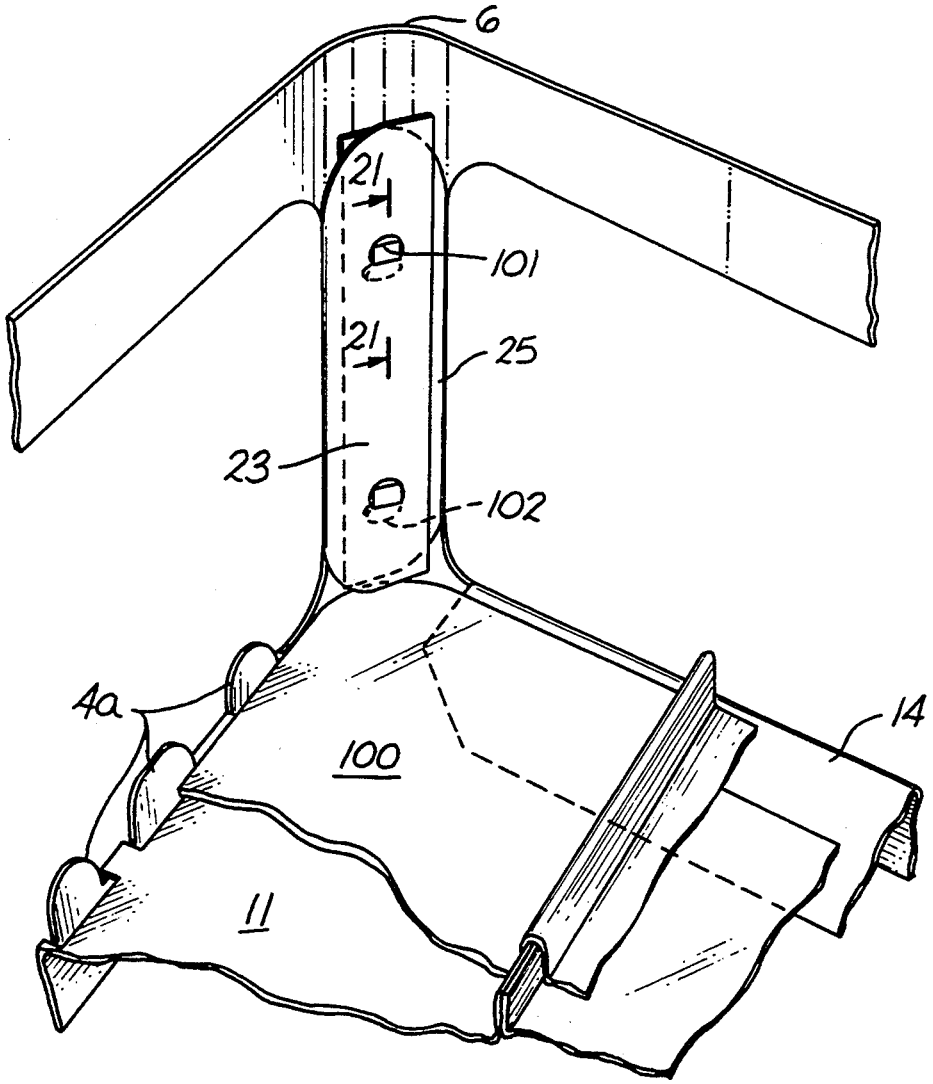
FIG. 20 is an enlarged perspective view as seen from the inside of a corner post and related parts of the stand shown in FIGS. 17, 18 and 19.
Figure 21:
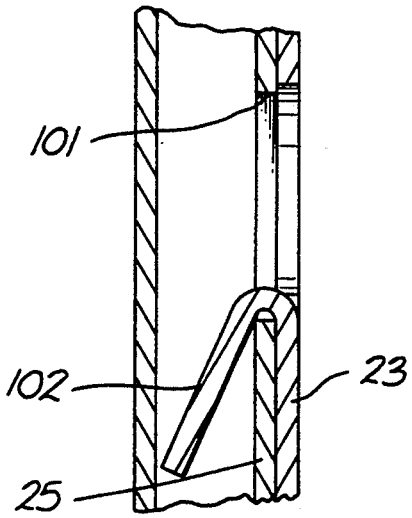
FIG. 21 is an enlarged cross sectional view taken along the line designated 21—21 in FIG. 20.

FIG. 20 shows an enlarged perspective view from the inside of a corner of a shelf formed according to a modification of this invention. As shown in FIG. 21, a circular aperture 101 is disposed in substantial coincidence with the locking element 102 which is inserted through the element 101 as is apparent in FIG. 20. The locking element 102 is circular while the receiving element 101 is rectangular.

Figure 22:
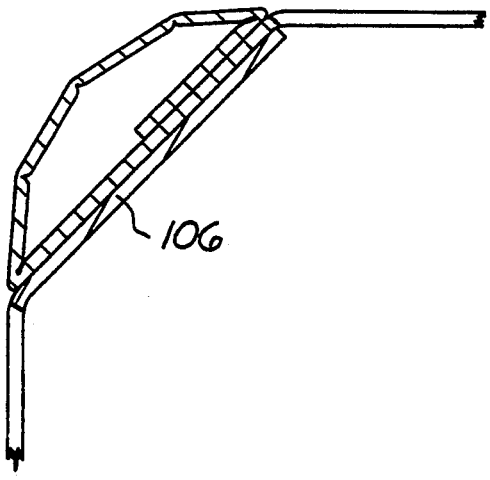
FIGS. 22, 23, 24, 25, 26 and 27 are simply horizontal cross sectional views taken of several versions of a corner post formed according to this invention.
Figure 23:
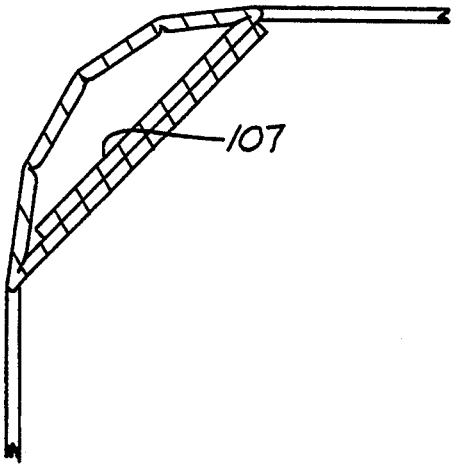
Figure 24:
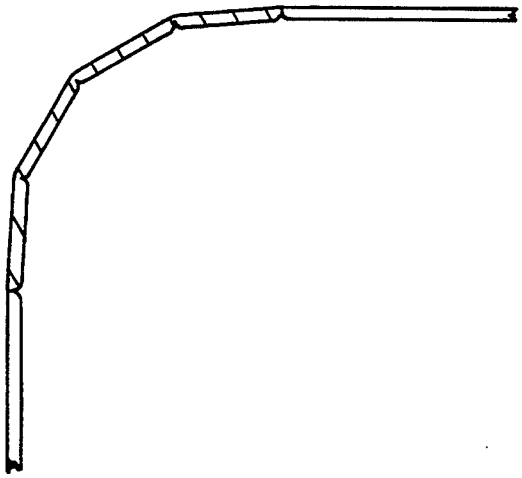
Figure 25:
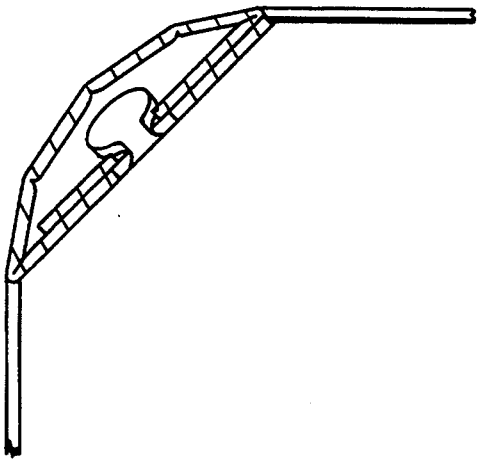
Figure 26:
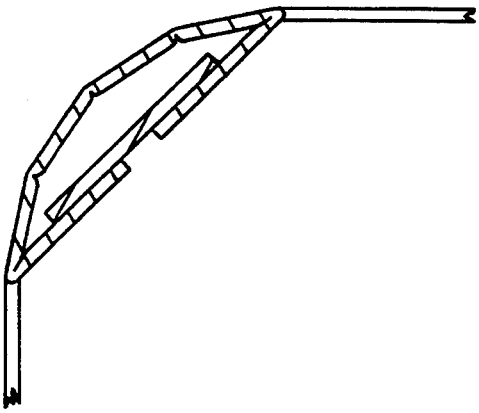
Figure 27:
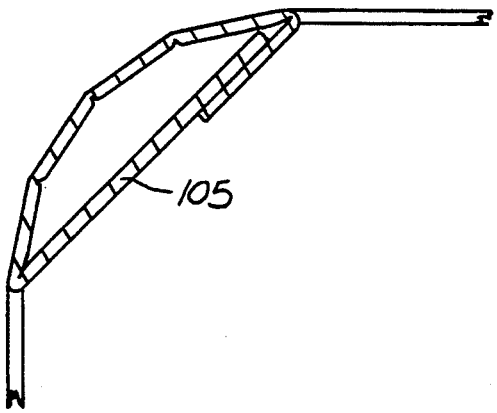

The corner structure of arcuate configuration in horizontal cross section may simply include the structure shown in FIG. 24, i.e., without a chordal unit. On the other hand, the structure is mechanically stronger if the chord is provided. The chords in FIGS. 22, 23, 25 and 27 include an element which determines the length of the arcuate portion from one side edge to the opposite side edge and for this reason these forms are desirable for many applications of the invention. As indicated in FIG. 25, mechanical means in the form of a securing tab, staple or adhesive or may be fastened by any other suitable means so as to hold the parts in the positions indicated in FIG. 25. In FIG. 27, the panel 105 determines the length of the chord as does the panel 106 in FIG. 22 and 107 in FIG. 23.

Of course, many other structures may be used in conjunction with this invention without departing from the scope of the invention.

It is clear that this development is advantageous over prior art structures because it affords a substantial increase in the mechanical strength of the structure and also because it affords a minimal obstruction to the view of the displayed items.

We claim:

1. A display stand formed of corrugated paperboard and comprising base structure, vertical corner posts supported by said base structure, a plurality of horizontal shelves supported by said vertical corner posts, a horizontal cross section of each of said corner posts being at least in part of arcuate cross sectional configuration, and support means interconnecting each of said shelves with said part of each of said corner posts which is of arcuate configuration.

2. A display stand according to claim 1 wherein each of said shelves is of quadrilateral configuration and includes a first pair of shelf elements respectively formed integrally with said support means and which include upwardly projecting inner reinforcing portions disposed in flat face contacting relation with each other.

3. A display stand according to claim 2 wherein a beam of inverted U-shaped cross section is disposed about each pair of said upwardly projecting inner reinforcing portions.

4. A display stand according to claim 3 wherein a downwardly projecting tab is integrally formed with each end portion of said beam and a second pair of shelf elements each having a holding aperture is respectively formed integrally with said support means, for respectively receiving one of said downwardly projecting tabs.

5. A display stand according to claim 4 wherein each of said holding apertures is in the form of an elongated slot and wherein each of said downwardly projecting tabs is disposed in its associated elongated slot.

6. A display stand according to claim 1 wherein the side edges of said part of arcuate configuration are bridged by a reinforcing chord.

7. A display stand according to claim 6 wherein said reinforcing chord comprises a pair of face contacting elements.

8. A display stand according to claim 6 wherein said reinforcing chord comprises a pair of face contacting elements each having one end formed integrally with a side of said part of arcuate configuration and wherein a locking element having an abutment end extends through an aperture in one of said face contacting elements and is secured to the other of said face contacting elements so as to hold said elements in secure face contacting relation to each other.

9. A display stand according to claim 6 wherein said reinforcing chord comprises a first element foldably joined to and integral with a side of said part of arcuate configuration and which is the same length as the desired length of said chord and wherein a second element is integral with the other side of said part which is of arcuate configuration and which is secured by mechanical means in face contacting relation with said first element.

10. A display stand according to claim 6 wherein said reinforcing chord comprises a pair of elements integral respectively with the side edges of said part of arcuate configuration and wherein a third element is secured to and in overlying relation with the adjacent edges of said pair of elements.

11. A display stand according to claim 1 wherein a securing strip is foldably joined to one side edge of each of said arcuate parts of each corner post and wherein a securing flap is foldably joined to an edge of each of said arcuate parts which is opposite from said one side edge and securing means for adjoining said securing strip and said securing flap together in flat face contacting relation to each other.

12. A display stand according to claim 11 wherein said securing means comprises adhesive means for holding said securing strip in flat face contacting relation with said securing flap to form a composite structure.

13. A display stand according to claim 11 wherein a locking aperture is formed in one component of said composite structure and a cooperating locking tab is struck from and foldably joined to the other component of said composite structure, said locking tab being inserted into said locking aperture to hold said securing strip in flat face contacting relation with said securing flap.

14. A display stand according to claim 13 wherein said locking aperture is of generally rectangular configuration and said locking tab is of generally circular configuration.

15. A display stand according to claim 1 wherein said support means includes a pair of shelf supporting arms.

16. A display stand according to claim 1 wherein each of said shelves comprises a pair of coplanar half shelves foldably joined respectively to said support means on opposite sides of said display stand, and wherein face contacting medial struts are foldably joined to the inner edges of said half shelves.

17. A display stand according to claim 16 wherein opposed horizontal end strips interconnected with said support means are collapsible medially thereof to provide for space saving collapse of said display stand in coordination with upward folding of said half shelves.

18. A display stand according to claim 16 wherein said half shelves are foldably joined to said support means along interrupted fold lines.

19. A display stand according to claim 16 wherein a separate reinforcing shelf panel is arranged to overlie said coplanar half shelves and wherein said reinforcing shelf panel includes medial strut structure configured to overlie and to envelope said face contacting medial struts.

20. A display stand according to claim 19 wherein a pair of fold down tabs are struck from said separate reinforcing shelf at each end of said medial strut structure and on opposite sides of said medial strut structure, said tabs having end portions arranged to underlie the associated half shelf so as to secure said separate reinforcing shelf in position atop said half shelves.

21. A corner post for a display stand comprising crease lines defining a horizontal cross section of arcuate configuration made up of a pair of outer strips and a plurality of adjoined vertically disposed inner strips, one of said outer strips being foldably joined to a securing flap forming a part of a chord of said part of arcuate cross sectional configuration, and another one of said strips being foldably joined to a securing strip disposed in flat face contacting relation to said securing flap thereby to form a chord which bridges said part of arcuate configuration.

* * * * *